US006243043B1

(12) United States Patent
Terashima et al.

(10) Patent No.: US 6,243,043 B1
(45) Date of Patent: Jun. 5, 2001

(54) GLASS ANTENNA DEVICE FOR AN AUTOMOBILE

(75) Inventors: Fumitaka Terashima; Kohji Tabata; Tsuyoshi Yamamoto, all of Chita-gun (JP)

(73) Assignee: Asahi Glass Company Ltd., Tokyo (JP)

( * ) Notice: Subject to any disclaimer, the term of this patent is extended or adjusted under 35 U.S.C. 154(b) by 0 days.

(21) Appl. No.: 09/586,771

(22) Filed: Jun. 5, 2000

Related U.S. Application Data

(63) Continuation of application No. 09/016,418, filed on Jan. 30, 1998, now Pat. No. 6,072,435.

(30) Foreign Application Priority Data

| | | |
|---|---|---|
| Jan. 31, 1997 | (JP) | 9-19168 |
| Jul. 22, 1997 | (JP) | 9-196086 |
| Nov. 12, 1997 | (JP) | 9-310909 |

(51) Int. Cl.[7] ..... H01Q 1/32
(52) U.S. Cl. ..... 343/713; 343/704
(58) Field of Search ..... 343/704, 711, 343/712, 713, 850, 860, 725; H01Q 1/32, 21/30

(56) References Cited

U.S. PATENT DOCUMENTS

| | | | | |
|---|---|---|---|---|
| 4,063,247 | * | 12/1977 | Sakurai et al. | 343/704 |
| 4,992,801 | | 2/1991 | Satio et al. . | |
| 5,083,134 | | 1/1992 | Saitou et al. . | |
| 5,198,825 | | 3/1993 | Sakaurai et al. . | |
| 5,239,302 | | 8/1993 | Maeda et al. . | |
| 5,598,170 | | 1/1997 | Nakase . | |
| 5,654,720 | | 8/1997 | Saitou et al. . | |
| 5,654,721 | | 8/1997 | Saitou et al. . | |
| 5,719,585 | * | 2/1998 | Tabata et al. | 343/713 |
| 5,877,727 | | 3/1999 | Saitou et al. . | |
| 5,905,468 | | 5/1999 | Ikawa et al. . | |
| 6,072,435 | * | 6/2000 | Terashima et al. | 343/713 |

FOREIGN PATENT DOCUMENTS

| | | |
|---|---|---|
| 0 146 339 A2 | 6/1985 | (EP) . |
| 0 506 333 A1 | 9/1992 | (EP) . |
| 0 807 987 A2 | 11/1997 | (EP) . |
| 2-311002 | 12/1990 | (JP) . |
| 4-287405 | 10/1992 | (JP) . |
| 6-177626 | 6/1994 | (JP) . |
| 9-307333 | 11/1997 | (JP) . |

* cited by examiner

*Primary Examiner*—Tho Phan
(74) *Attorney, Agent, or Firm*—Oblon, Spivak, McClelland, Maier & Neustadt, P.C.

(57) ABSTRACT

A first resonance is generated by the inductance of a first coil connected between a first antenna conductor in a window glass sheet and a receiver and the impedance of the antenna conductor, and a second resonance is generated by the inductance of a second coil connected between a second antenna conductor 3*b* and an automobile body as the earth. The antenna conductor and the antenna conductor are in a capacitive coupling relation, whereby signals in different broadcast band: a low frequency band and a high frequency band, are well received.

24 Claims, 9 Drawing Sheets

FM SENSITIVITY

GLASS ANTENNA DEVICE FOR AN AUTOMOBILE

This appln is a con't of Ser. No. 09/016,418 filed Jan. 30, 1998, U.S. Pat. No. 6,072,435.

BACKGROUND OF THE INVENTION

The present invention relates to a glass antenna device for an automobile suitable for received signals in a long wave broadcast band (LW band)(150–280 kHz), a middle wave broadcast band (530–1630 kHz), a short wave broadcast band (SW band)(2.3–26.1 MHz), an FM broadcast band (76–90 MHz, (Japan)), an FM broadcast band (88–108 MHz (U.S.A.)), a TV-VHF band (90–108 MHz and 170–222 MHz) and a TV-UHF band (470–770 MHZ), which has a high signal receiving sensitivity and a noise suppressing property and which is rich in productivity.

DISCUSSION OF THE BACKGROUND

As a glass antenna device for an automobile which is capable of improving the signal receiving sensitivity by utilizing resonance, there has been proposed a glass antenna device for an automobile as shown in FIG. 7 (JP-Y-4-53070).

In this conventional example, a defogger 90 comprising heater strips 2 and bus bars 15*a*, 15*b*, 15*c* is provided in a rear window glass sheet 1 of an automobile, a choke coil 9 is connected between the bus bars 15*a*, 15*b* and a d.c. power source 10 for the defogger 90 wherein the impedance of the coke coil 9 is increased in a high frequency band region to thereby allow a direct current to flow from the d.c. power source 10 to the defogger 90, and to stop a current of high frequency band region such as a broadcast frequency band region, in which the defogger 90 is utilized as an antenna.

Further, a parallel resonance is generated by the stray capacitance to ground (hereinbelow, referred to simply as the stray capacitance) of the defogger 90 and a coil 71 in a middle wave broadcast band. Further, a received signal in the middle wave broadcast is passed by the coil 71, a capacitor 73 and a resistor 74. Reference numeral 11 designates a capacitor for cutting noises.

In the conventional example shown in FIG. 7, which employs the above-mentioned construction, an attempt has been made to improve the signal receiving sensitivity and to reduce noises.

However, in the conventional example, the stray capacitance of a cable which connects the defogger 90 to a receiver was an element to generate the parallel resonance. Further, the S/N ratio was poor because the parallel resonance frequency existed in a middle broadcast band, and the receiving sensitivity was insufficient because the resonance occurred in a single portion.

Further, when the defogger 90 was utilized as an antenna commonly used for a middle wave broadcast band and FM broadcast band and even when the shape of the defogger 90 was optimized for receiving middle wave broadcast signals, there were problems that the signal receiving sensitivity and the directivity for a FM broadcast were insufficient in a case of receiving middle wave broadcast signals.

SUMMARY OF THE INVENTION

It is an object of the present invention to eliminate the above-mentioned drawback of the conventional technique, and to provide an improved glass antenna device for an automobile which is of high signal receiving sensitivity, reducing noises and excellent productivity.

In accordance with the present invention, there is provided a glass antenna device for an automobile which comprises:

a first coil; a second coil; a first antenna conductor provided in a window glass sheet fitted to an opening of an automobile; and a second antenna conductor provided in the window glass sheet, wherein a first resonance is generated by the impedance of the first antenna conductor and the inductance of the first coil as resonance elements;

a second resonance is generated by the impedance of the second antenna conductor and the inductance of the second coil as resonance elements;

the second antenna conductor has a length and a shape for a first received signal frequency band;

the first antenna conductor has a length and a shape for a second received signal frequency band which is higher in frequency than the first received signal frequency band;

a resonance frequency which causes the first resonance and a resonance frequency which causes the second resonance are frequencies by which the sensitivity to the first received signal frequency band is increased; and the first antenna conductor is electrically connected to the second antenna conductor.

In the above-mentioned invention, the first antenna conductor is electrically connected to the second antenna conductor by at least one selected from the group consisting of 1) a capacitive coupling of both antenna conductors due to a close position, 2) the connection of a capacitor, 3) the connection of a resistor, and 4) the connection of a coil.

Further, in accordance with the present invention, there is provided a glass antenna device for an automobile which comprises:

a first coil; a second coil; a first antenna conductor provided in a window glass sheet fitted to an opening of an automobile; and a second antenna conductor provided in the window glass sheet, wherein a first resonance is generated by the impedance of the first antenna conductor and the inductance of the first coil as resonance elements;

a second resonance is generated by the impedance of the second antenna conductor and the inductance of the second coil as resonance elements;

a received signal in a first received signal frequency band and a received signal in a second received signal frequency band which is higher in frequency than the first received signal frequency band are supplied from the first antenna conductor to a receiver;

a resonance frequency which causes the first resonance and a resonance frequency which causes the second resonance are frequencies by which the sensitivity to the first received signal frequency band is increased; and a filter circuit for blocking or attenuating the received signal in the second frequency band is electrically connected between the first antenna conductor and the second antenna conductor.

In the above-mentioned invention, the first coil is electrically connected between the first antenna conductor and a receiver, and the second coil is electrically connected between the second antenna conductor and the automobile body as the earth.

Further, in the above-mentioned invention, the first resonance is a series resonance and the second resonance is a parallel resonance.

Further, in the above-mentioned invention, the first received signal frequency band is a middle frequency band and the second received signal frequency band is at least one selected from the group consisting of an FM broadcast band, a TV-VHF band and a TV-UHF band.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
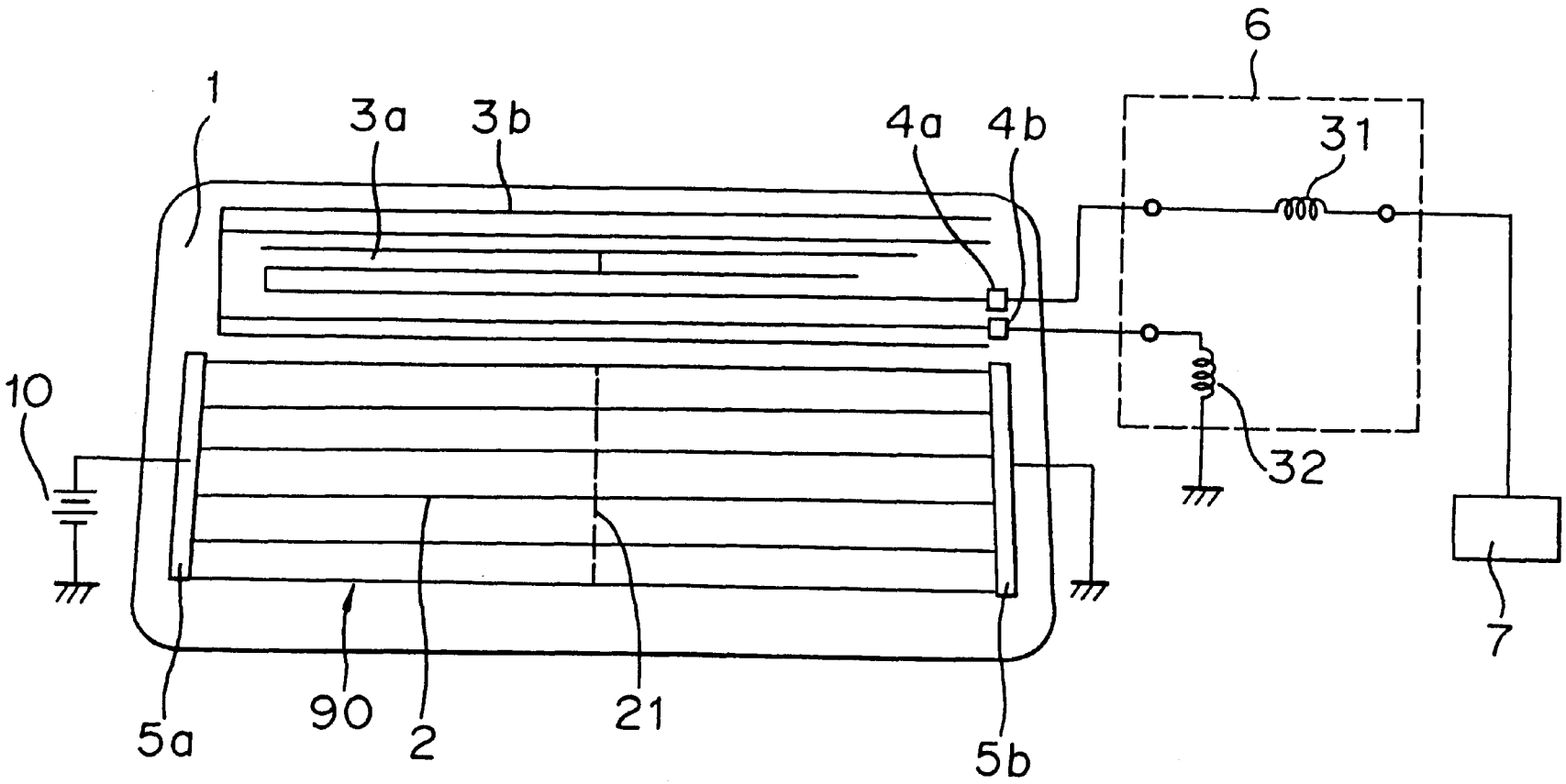
FIG. 1 is in diagram showing the basic structure of an embodiment of the glass antenna device for an automobile according to the present invention.

Detailed description of preferred embodiments of the present invention will be described with reference to the drawings wherein the same reference numerals designate the same or corresponding parts.

FIG. 1 is a diagram showing the basic structure of an embodiment of the glass antenna device for an automobile of the present invention wherein a rear window glass sheet 1 for an automobile is used. In FIG. 1, reference numeral 2 designates heater strips, numeral 3*a* designates a first antenna conductor, numeral 3*b* designates a second antenna conductor, numerals 4*a*, 4*b* designate power feeding points, numerals 5*a*, 5*b* designate bus bars, numeral 6 designates a resonance circuit, numeral 7 designates a receiver, numeral 21 designates a shortcircuit line, numeral 31 designates a first coil, numeral 32 designates a second coil and numeral 90 designates a defogger.

For improving the sensitivity, it is preferable that the first antenna conductor 3*a* and the second antenna conductor 3*b* are close to each other so as to have a capacitive coupling relation. The distance between the first antenna conductor 3*a* and the second antenna conductor 3*b* is generally about 0.1–50 mm for the capacitive coupling. The transmitting and receiving of a direct current are not effected between the first antenna conductor 3*a* and the second antenna conductor 3*b* in the capacitive coupling relation, however, the transmitting and receiving of a high frequency electric current of received signal can be effected.

In FIG. 1, the first antenna conductor 3*a* and the second antenna conductor 3*b* are not connected by means of a circuit. However, in a case that the first antenna conductor 3*a* and the second antenna conductor 3*b* are connected by means of a circuit; the first antenna conductor 3*a* and the second antenna conductor 3*b* are formed in one piece, and the effective length of the first antenna conductor 3*a* and the effective length of the second antenna conductor 3*b* are elongated, the first antenna conductor 3*a* and the second antenna conductor 3*b* may be or may not be in a capacitive coupling relation.

In a case that the electric heating type defogger 90 comprising a heater strips 2 and the bus bars 5*a*, 5*b* for supplying a current to the heater strips 2 is provided in the rear window glass sheet 1 as shown in FIG. 1, it is preferable that the second antenna conductor 3*b* and the defogger 90 are in a capacitive coupling relation. It is because a received signal induced in the defogger 90 is transmitted to the second antenna conductor 3*b* in order to improve the signal receiving sensitivity. When the second antenna conductor 3*b* is in a capacitive coupling relation to the defogger 90, the signal receiving sensitivity is generally increased 0.5 dB or more in comparison with a case without the capacitive coupling relation.

In FIG. 1, when the second antenna conductor 3*b* and the defogger 90 are close to each other, the both members have the capacitive coupling. However, the present invention is not limited thereto, and at least one of the first antenna conductor 3*a* and the second antenna conductor 3*b* may be close to the defogger 90 for capacitive coupling. In this case, substantially the same effect as the case that the second antenna conductor 3*b* and the defogger 90 are in a capacitive coupling relation is obtainable.

In FIG. 1, a choke coil 9 as in FIG. 9, which will be described later, is not provided, and the defogger 90 and the d.c. power source 10 are in a direct connection. The structure shown in FIG. 1 implies that the defogger 90 is not isolated from the automobile body as the earth in a broadcast frequency band region. When the capacitance in the capacitive coupling relation is too large, a received signal induced in the first antenna conductor 3*a* or the second antenna conductor 3*b* leaks to the automobile body as the earth through the defogger 90 whereby the signal receiving sensitivity is reduced.

Further, when the capacitance in the capacitive coupling relation is too large, engine noises in the defogger 90 enter in the first antenna conductor 3*a* or the second antenna conductor 3*b* to deteriorate the S/N ratio. In the case that the choke coil 9 is not provided, it is preferable that the coupled capacitance of at least one of the first and second antenna conductors 3*a*, 3*b* and the defogger 90 is generally 100 pF or less. When it is 100 pF or less, the signal receiving sensitivity is generally improved 0.5 dB or more in comparison with a case that it is more than 100 pF.

Similarly, from the viewpoint of the S/N ratio, it is preferable that the coupled capacitance of at least one of the first and second antenna conductors 3*a*, 3*b* and the defogger 90 is generally 50 pF or less. When it is 50 pF or less, the S/N ratio is generally increased 2.0 dB or more in comparison with a case that it is more than 50 pF. A more preferable range is 25 pF or less. When it is 25 pF or less, the S/M ratio is generally improved 3.0 dB or more in comparison with a case that it is more than 25 pF.

A shortcircuit line 21 may be provided to shortcircuit a plurality of heater strips in the rear window glass sheet 1 at a position other than the bus bars as shown in FIG. 1.

The shortcircuit line 21 for shortcircuiting the heater strips at a position other than the bus bars is provided according to requirement, and it has a function for stabilizing the impedance of the defogger 90 when the defogger 90 is utilized as an antenna. Further, the shortcircuit line 21 has a function for received signals in a high frequency band.

Figure 2:
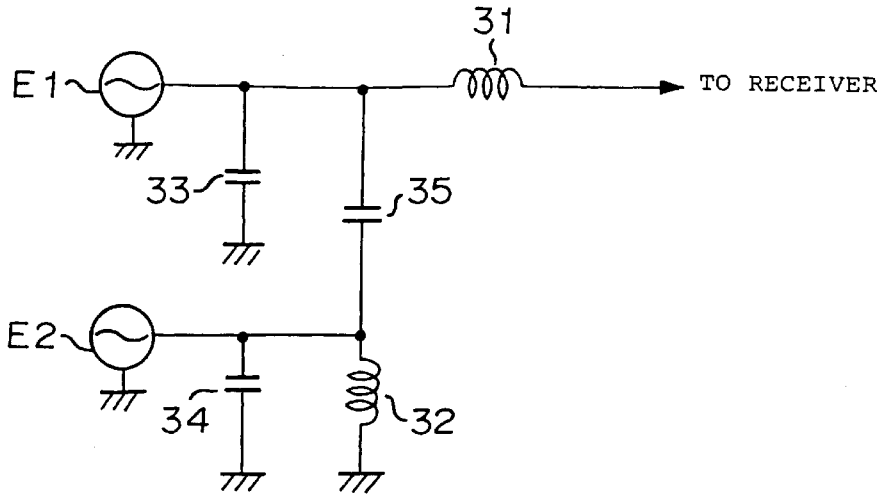
FIG. 2 is an equivalent circuit diagram showing a capacitive coupling relation between the first antenna conductor 3*a* and the second antenna conductor 3*b* in the device shown in FIG. 1.

FIG. 2 is an equivalent circuit diagram showing a case that the first antenna conductor 3*a* is made capacitive coupling to the second antenna conductor 3*b* in the device shown in FIG. 1. In FIG. 2, El designates a voltage power source to apply a voltage to the first antenna conductor 3*a*, E2 designates a voltage power source for applying a voltage to the second antenna conductor 3*b*, numeral 33 designates the stray capacitance to ground (hereinbelow, referred to simply as the stray capacitance) of the first antenna conductor 3*a*, numeral 34 designates the stray capacitance of the second antenna conductor 3*b*, and numeral 35 designates the close capacitance of the first and second antenna conductors 3*a*, 3*b*.

The second antenna conductor 3*b* is preferably used mainly for received signals in a first received signal frequency band (hereinbelow referred to as a low frequency band), and it is preferable that the length and the shape of the antenna conductor 3*b* are determined to obtain a desired signal receiving performance in the low frequency band. The first antenna conductor 3*a* is preferably used for received signals in a second received signal frequency band (hereinbelow, referred to as a high frequency band) which is higher than the low frequency band, and the length and the shape of the antenna conductor 3*a* are determined to obtain a desired signal receiving performance in the high frequency band.

For example, when the high frequency band is so determined as to include an FM broadcast band, a TV-VHF band or a TV-UHF band, the dimension in the lateral direction of each element constituting the first antenna conductor 3*a* should satisfy $(\lambda_H/4)\times K \sim \lambda_L \times K$ where K represents a reduction rate of glass, $\lambda_H$ represents the wavelength of the highest frequency of the high frequency band and $\lambda_L$ represents the wavelength of the lowest frequency of the highest frequency band. The reduction rate of glass is 0.64.

When the low frequency band is determined to be a middle broadcast band, it is preferable that the length of the second antenna conductor 3*b* should be long as possible so that the usable area is maximized. The second antenna conductor 3*b* is preferably provided in the window glass sheet 1 so as to surround the substantial part of the first antenna conductor 3*a* because the capacitive coupling between the both antennas is easily obtainable while the length of the second antenna conductor 3*b* be long as possible.

The first antenna conductor 3*a* and the second antenna conductor 3*b* can be those for received signals in a middle broadcast band, an FM broadcast band, a short wave broadcast band, a long wave broadcast and, a TV-VHF band, a TV-UHF band and telephone. For example, the low frequency band is generally for the middle wave broadcast band and the high frequency band is for at least one of the FM broadcast band, the TV-VHF band and the TV-UHF band.

In the present invention, resonance is generated in two portions to thereby improve the signal receiving sensitivity. In the first resonance, the impedance of the first antenna conductor and the inductance of the first coil are included as resonance elements.

The impedance of the first antenna conductor 3*a* is composed mainly of a stray capacitance 33. The impedance of the first antenna conductor 3*a* is the impedance of the first antenna conductor side viewed from the power feeding point 4*a*. Further, a resonance frequency for the first resonance may be adjusted by connecting a capacitive component in parallel between the stray capacitance 33 and the automobile body as the earth. The capacitive component can be a resonance element for the first resonance.

The first resonance is influenced by the stray capacitance of a wire located around the first coil 31, the stray capacitance of a cable connected between the glass antenna and the receiver and the close capacitance 35, which can be resonance elements for the first resonance.

Further, impedance matching may be conducted between the first antenna conductor 3*a* and the receiver side by adding a new circuit element in the resonance circuit 6. The first coil 31 used is generally of about 10 $\mu$H-l mH.

With respect to the second resonance, the impedance of the second antenna conductor 3*b* and the inductance of the second coil 32 are included as resonance elements. The impedance of the second antenna conductor 3*b* is composed mainly of a stray capacitance 34. The impedance of the second antenna conductor 3*b* is the impedance of the second antenna conductor side viewed from the power feeding point 4*b*. Further, a resonance frequency for the second resonance may be adjusted by connecting a capacitive component in parallel between the stray capacitance 34 and the automobile body as the earth. The capacitive component can also be a resonance element for the second resonance.

The second coil 32 used is generally of about 10 $\mu$H-l mH. Further, for the second resonance, the stray capacitance of a wire located around the second coil 32 and the close capacitance 35 can also be resonance elements for the second resonance. The stray capacitance of a cable connected between the resonance circuit 6 and the receiver also influences to the second resonance.

In case that the second coil 32 loses its inductance (i.e. it gets a capacitive property) in a high frequency band such as an FM broadcast frequency among a broadcast frequency,. received signals leak to the automobile body as the earth whereby the signal receiving sensitivity becomes poor. In order to prevent such disadvantage, a high frequency choke coil (not shown) may be connected in series to the second coil 32. The high frequency choke coil used is generally of about 0.1–100 $\mu$H.

When the first antenna conductor 3*a* and the second antenna conductor 3*b* are coupled in a capacitive relation, received signals in the second antenna conductor 3*b* are transmitted to the receiver side through the close capacitance 35. Impedance matching may be conducted between the second antenna conductor 3*b* and the receiver side by providing a new circuit element in the resonance circuit 6. In FIG. 1, the first resonance is a series resonance and the second resonance is a parallel resonance. Although it is preferable to generate the above-mentioned resonance from the viewpoint of improving the sensitivity in the present invention, the first resonance is not limited to the series resonance and the second resonance is not limited to the parallel resonance.

The reason why resonance is generated in the two portions in the present invention is because only the single resonance can not cover a broader received signal frequency band region. In the present invention, accordingly, the low frequency band region is divided into two portions with respect to the substantially central frequency wherein the divided portions are respectively shared by the two portions of resonance whereby the signal receiving sensitivity is flattened. Here, the signal receiving sensitivity means that a difference between the highest signal receiving sensitivity and the lowest signal receiving sensitivity in a band region such as a low frequency band region is reduced.

A resonance frequency for the first resonance and a resonance frequency for the second resonance are determined to be frequencies by which the sensitivity in the low frequency band is improved. However, it is preferable from the viewpoint of flattening the signal receiving sensitivity that a resonance frequency for the first resonance exists between a frequency of 1.5 $f_H$ and the substantially central frequency of the low frequency band where $f_H$ indicates the highest frequency of the low frequency band, and a resonance frequency for the second resonance exist between a frequency of 0.6 $f_L$ and the substantially central frequency of the low frequency band where $f_L$ indicates the lowest frequency of the low frequency band. When the above-mentioned resonance frequencies are out of these ranges, it is difficult that a difference between the highest signal receiving sensitivity and the lowest signal receiving sensitivity in the low frequency band is generally about 10 dB or less, and the flatness in the signal receiving sensitivity in the low frequency band is poor.

Further, it is preferable the from the viewpoint of improving the signal receiving sensitivity that the resonance frequency for the first resonance is in the low frequency band. When it is in the low frequency band, the signal receiving sensitivity is generally improved about 10 dB over the entire frequency band in comparison with a case that the resonance frequency is not. Accordingly, in order to improve both aspects of the flatness and the signal receiving sensitivity, the resonance frequency for the first resonance should be between $f_H$ and the substantially central frequency of the low frequency band, and the resonance frequency for the second resonance be between a frequency of 0.6 $f_L$ and the substantially central frequency of the low frequency band.

When the first resonance is a series resonance, the resonance frequency for the first resonance should preferably be higher than the substantially central frequency of the low frequency band. When the second resonance is a parallel resonance, the resonance frequency for the second resonance is preferably lower than the substantially central frequency of the low frequency band. when the second resonance is a parallel resonance, there is a remarkable reduction of signal receiving sensitivity in a range lower than the resonance frequency in the parallel resonance.

Figure 3:
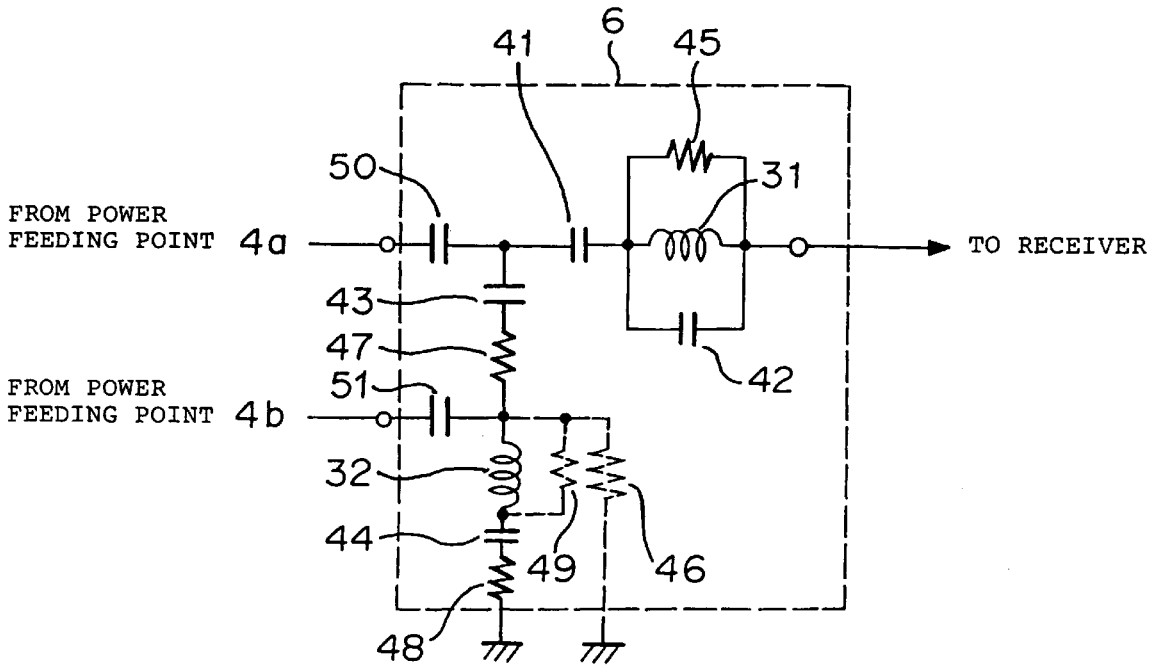
FIG. 3 is a circuit diagram of a resonance circuit 6 which is in a modified form of that shown in FIG. 1.

FIG. 3 is a circuit diagrams showing a modified embodiment of the resonance circuit 6. In FIG. 3, reference numerals 41, 44, 50 and 51 designate capacitors for cutting a direct current, numeral 42 designates a bypass capacitor, numeral 43 designates a coupling capacitor, numerals 45, 46, 48 and 49 designate damping resistors, and numeral 47 designates a resistor for reducing noises of automobile such as engine noises.

In the resonance circuit in FIG. 3, received signals in the second antenna conductor 3*b* are transmitted to the receiver side through the capacitor 51, the resistor 47 and the capacitor 43. However, when the first antenna conductor 3*b* has a capacitive coupling relation to the second antenna conductor 3*b*, the received signals in the second antenna conductor 3*b* are also transmitted to the receiver side through the close capacitance 35.

The bypass capacitor 42, which is provided according to requirement, has a function of passing high frequency band signals to the receiver side. For example, when the low frequency band is for a middle wave broadcast band as well as an FM broadcast band, the signals in the FM broadcast band are allowed to pass by the bypass capacitor 42.

The capacitor 43 is to strengthen the capacitive coupling of the first antenna conductor 3*a* and the second antenna conductor 3*b*, which is provided according to requirement. The connection between the first antenna conductor 3*a* and the second antenna conductor 3*b* is performed by the capacitor 43 in the embodiment shown in FIG. 3. However, another element such as a resistor may be used for the connection. Further, for the adjustment of the flatness of signal receiving sensitivity, the resistors 45, 46, 48 and 49 are provided according to requirement. Further, an element such as a capacitor for adjusting the resonance may be provided.

The capacitors 41, 44, 50 and 51 are provided according to requirement, and such ones of 100 pF-50 $\mu$F are usually used. For the bypass capacitor 42, such one having 1–1000 pF is usually used. For the capacitor 43, such one having 5–500 pF is usually used. For the resistors 45, 46 and 49, such ones having 50Ω–100kΩ are usually used.

The stray capacitance of the cable which connects the resonance circuit 6 to the receiver 7 adversely affects the second resonance to thereby invite the deterioration of the S/N ratio due to noises of automobile such as engine noises. The resistor 47, which is provided according to requirement, has a function to prevent the deterioration of the S/N ratio. In particular, it has a function to prevent the deterioration of the S/N ratio in a lower region of the middle wave broadcast band. Namely, the resistor 47 functions to reduce the noises of automobile such as engine noises and so on.

The resistance value of the resistor 47 is preferably 10Ω–1kΩ, more preferably, 50–500Ω. When the low frequency band is a middle wave broadcast band and the resistance value of the resistor 47 is determined to be 10Ω–1kΩ, the S/N ratio in the middle wave broadcast band is improved 1 dB or more in comparison with a case outside of the range of 10Ω–1k Ω. When the resistance value of the resistor 47 is to be 50–500Ω, the S/N ratio in the middle wave broadcast band is improved 1 dB or more in comparison with a case out of the range of 50–500Ω.

As described above, the capacitors 41, 42, 43, 44, 50 and 51 and the resistors 45, 46, 47, 48 and 49 in FIG. 3 are provided according to requirement or may be omitted. Here, the omission of the capacitor 42 and the omission of the resistors 45, 46 and 49 implies opening, and the omission of the capacitors 41, 43, 44, 50 and 51 and the omission of the resistor 47 and 48 implies shortcircuiting.

Figure 6:
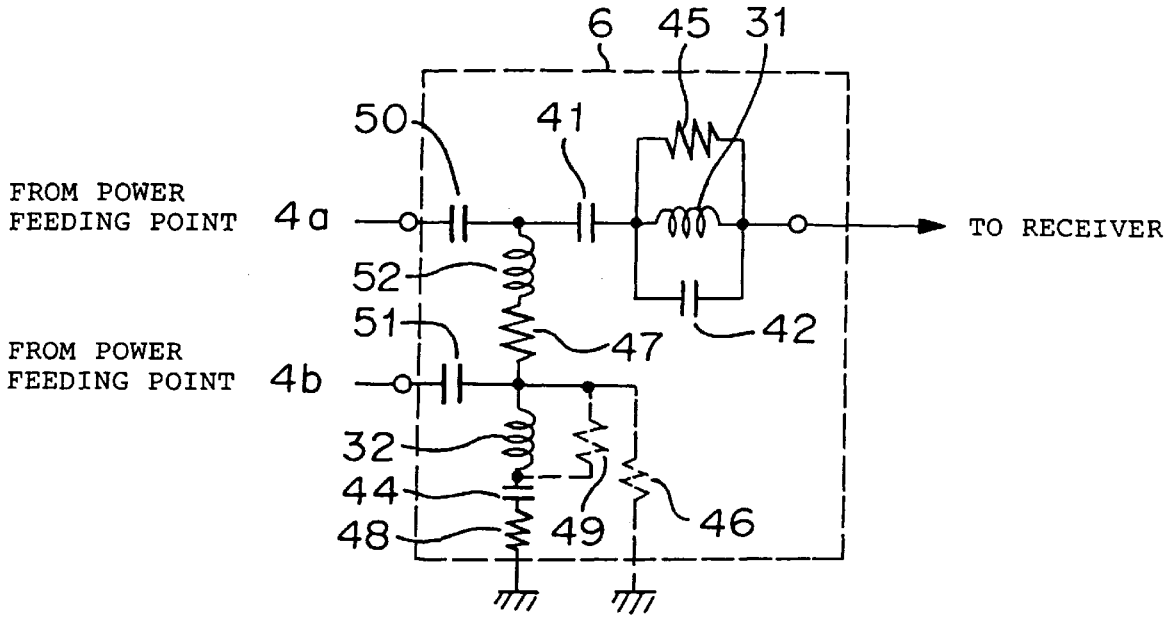
FIG. 6 is a circuit diagram showing a resonance circuit 6 different from that in FIG. 3.

FIG. 6 is a circuit diagram showing a different type of resonance circuit from that shown in FIG. 3. In FIG. 6, reference numeral 52 designates a high frequency choke coil. The high frequency choke coil 52 is provided according to requirement. The omission of the high frequency choke coil 52 implies shortcircuiting.

The high frequency choke coil 52 has a function to separate in terms of high frequency the first antenna conductor 3*a* from the second antenna conductor 3*b* in a high frequency band to thereby improve the signal receiving sensitivity in the high frequency band without changing the effective length of the first antenna conductor 3*a*. The high frequency choke coil 52 used is generally of about 0.1–1000 μH.

When the second coil 32 has a low self-resonance frequency in a high frequency band so that its inductance is lost, received signals in the high frequency band which are excited in the first antenna conductor 3*a* leak to the automobile body as the earth through the second coil 32 so that the signal receiving sensitivity becomes poor. Accordingly, the high frequency choke coil 52 which does not lose its inductance in the high frequency band (i.e., it does not get a capacitive property) prevents the received signals in the high frequency band from leaking to the automobile body as the earth through the second coil 32. In other words, the high frequency choke coil 52 has a function which allows signals in the low frequency band to pass therethrough and to block or attenuate signals in the high frequency band. When the high frequency choke coil 52 is provided, the signal receiving sensitivity to high frequency band is generally improved 1 dB or more in comparison with a case without providing it.

In FIG. 6, the high frequency choke coil 52 is connected between the first antenna conductor 3*a* and the second antenna conductor 3*b* in order to prevent the received signals in the high frequency band which are excited in the first antenna conductor 3*a* from leaking to the automobile body as the earth. However, the present invention is not limited thereto, and any type of filter circuit may be used as far as it is connected between the first antenna conductor 3*a* and the second antenna conductor 3*b* to block or attenuate received signals in the high frequency band.

Figure 8:
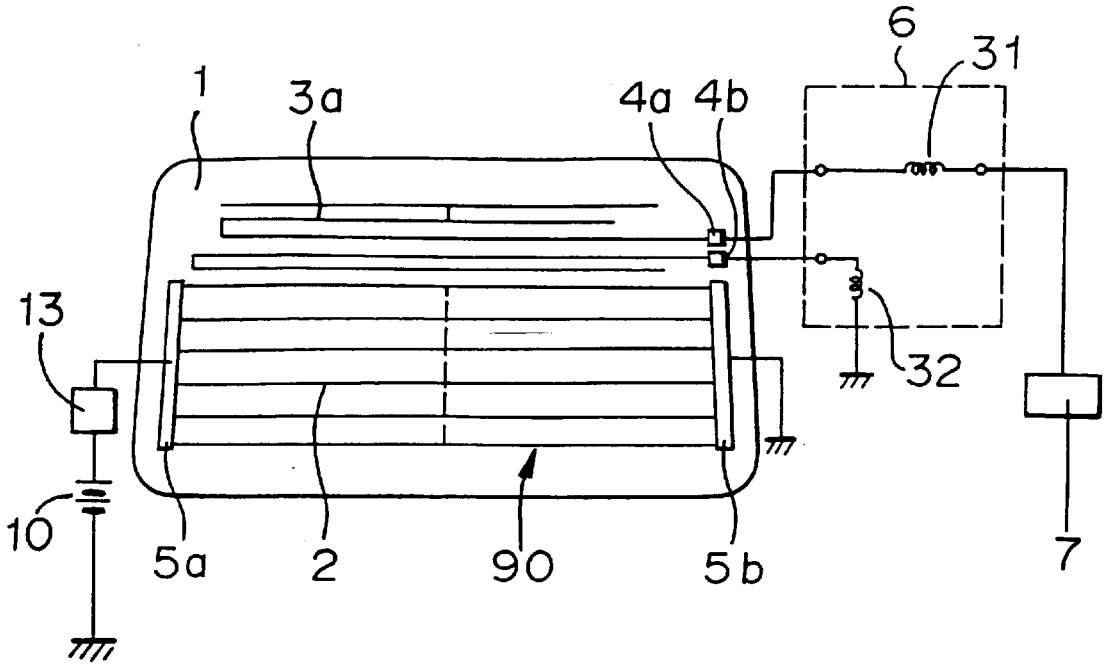
FIG. 8 is a structural diagram showing a glass antenna device for an automobile according to the present invention which is of a different type from that shown in FIG. 1.

In FIG. 1, in a case that the second antenna conductor 3*b* and the defogger 90 are brought to have a slight capacitive coupling relation, engine noises in the defogger 90 tend to flow into the second antenna conductor 3*b* whereby the S/N ratio becomes deteriorated. In order to prevent the disadvantage by the engine noises, it is preferable to connect a noise filter circuit 13 between the bus bar 5*a* and the d.c. power source for the defogger 90 as shown in FIG. 8. In the connection of the noise filter circuit 13, the S/N ratio in the low frequency band is increased several dB or more in comparison with a case without the connection.

Figure 10:
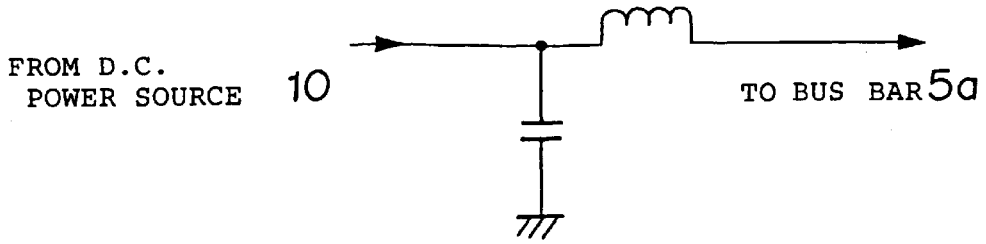
FIG. 10 is a circuit diagram showing a noise filter circuit in the present invention.

A typical example of the noise filter circuit 13 is shown in FIG. 10. The noise filter circuit in FIG. 10 consists of a capacitor and a coil in which a capacitor of 0.1–20 μF and a coil of 0.1–10 μH are generally used. The noise filter circuit is not limited to have the structure as shown in FIG. 10.

In FIG. 1, the second antenna conductor 3*b* is not adjacent to the defogger 90. Accordingly, the defogger 90 and the second antenna conductor 3*b* are not substantially or completely in a capacitive coupling relation. Therefore, the defogger 90 is not substantially isolated from the automobile body as the earth with respect to high frequency signals.

However, as described before, at least one between the first antenna conductor 3*a* and the second antenna conductor 3*b* may be close to the defogger 90 in order to have a capacitive coupling relation. When they are in a complete capacitive coupling relation, it is preferable to connect a choke coil 9, as shown in FIG. 9, between the defogger 90 and the d.c. power source 10 for the defogger 90 so that the defogger 90 is isolated from the automobile body as the earth. In such capacitive coupling, the signal receiving sensitivity is improved several dB or more in comparison with a case without the capacitive coupling. The distance of the both members for the capacitive coupling is generally about 0.1–50 mm. A choke coil 9 having about 0.1–10 mE is generally used.

Figure 9:
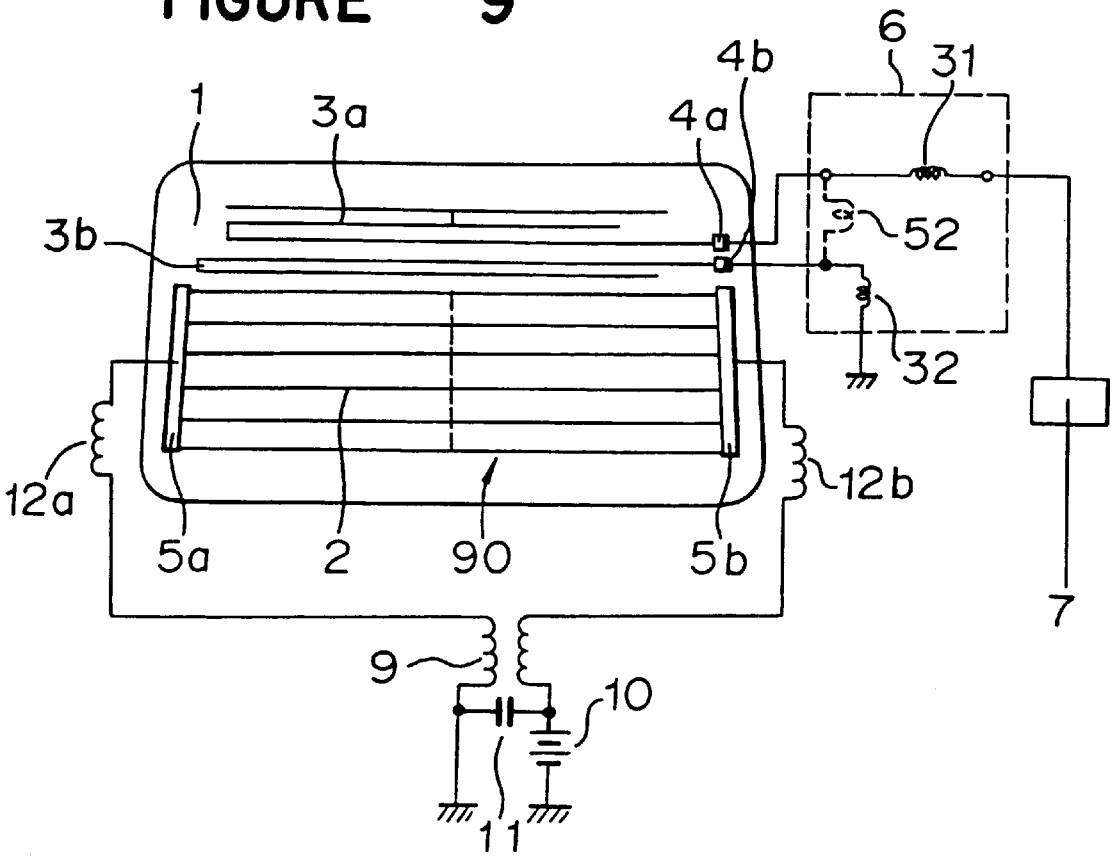
FIG. 9 is a structural diagram showing a glass antenna device for an automobile of the present invention which is of a different type from that shown in FIG. 1.

In FIG. 9, the choke coil 9 and high frequency choke coils 12*a*, 12*b* are inserted between the bus bars 5*a*, 5*b* and the d.c. power source 10 for the defogger 90 to thereby increase the impedance of the choke coil 9 and the high frequency choke coils 12*a*, 12*b* in a broadcast frequency band region, whereby a direct current from the d.c. power source 10 to the defogger 90 is allowed to flow and a current in the broadcast frequency band region is blocked.

Thus, the heater strips 2 and the bus bars 5*a*, 5*b* in the defogger 90 are isolated from the automobile body as the earth with respect to a high frequency signal by means of the choke coil 9 and the high frequency choke coils 12*a*, 12*b*, whereby a current of received signal of broadcast frequency band region induced in the defogger 90 is prevented from flowing into the automobile body as the earth. Thus, the current of the received signal is supplied to the receiver without leakage.

The high frequency choke coils 12*a*, 12*b* provide a high impedance in a high frequency band region such as an FM broadcast frequency band region in a broadcast frequency band region. Generally, solenoids or magnetic cores are used for the choke coils which exhibit an inductive type inductance in a high frequency band region such as an FM broadcast frequency band region or in the vicinity of such frequency band region. Since the choke coil 9 exhibits a low self-resonance frequency in a high frequency band region such as an FM broadcast frequency band region and sometimes loses its inductance, the high frequency choke coils 12*a*, 12*b* act for it. For the high frequency choke coils 12*a*, 12*b*, ones having about 0.1–100 μH are usually used.

When the choke coil 9 loses its inductance in a high frequency band region such as an FM broadcast frequency band region, the high frequency choke coils 12*a*, 12*b* are unnecessary. In short, when only signals in, for example, an AM broadcast frequency band are received, the high frequency choke coils 12*a*, 12*b* are generally unnecessary and it is enough to provide only the choke coil 9. When signals of high frequency band region such as FM broadcast frequency band region are received, only the high frequency choke coils 12*a*, 12*b* are required. If any coil or coils which perform both functions of the choke coil 9 and the high frequency choke coils 12*a*, 12*b* can be provided in a case of received signals in a low frequency band region and a high frequency band region, such coil or coils may be used.

In FIG. 91 a case that the first antenna conductor 3*a* and the defogger 90 are not in a capacitive coupling relation and the first antenna conductor 3*a* and the second antenna conductor 3*b* are also not in a capacitive coupling relation, is considered. In this case, if a high frequency choke coil 52 is connected between the first antenna conductor 3*a* and the second antenna conductor 3*b* even when the second antenna conductor 3*b* and the defogger 90 are in a capacitive coupling relation, the high frequency choke coils 12*a*, 12*b* are unnecessary and can be omitted, or the portions of the high frequency choke coils 12*a*, 12*b* can be shortcircuited.

Figure 12:
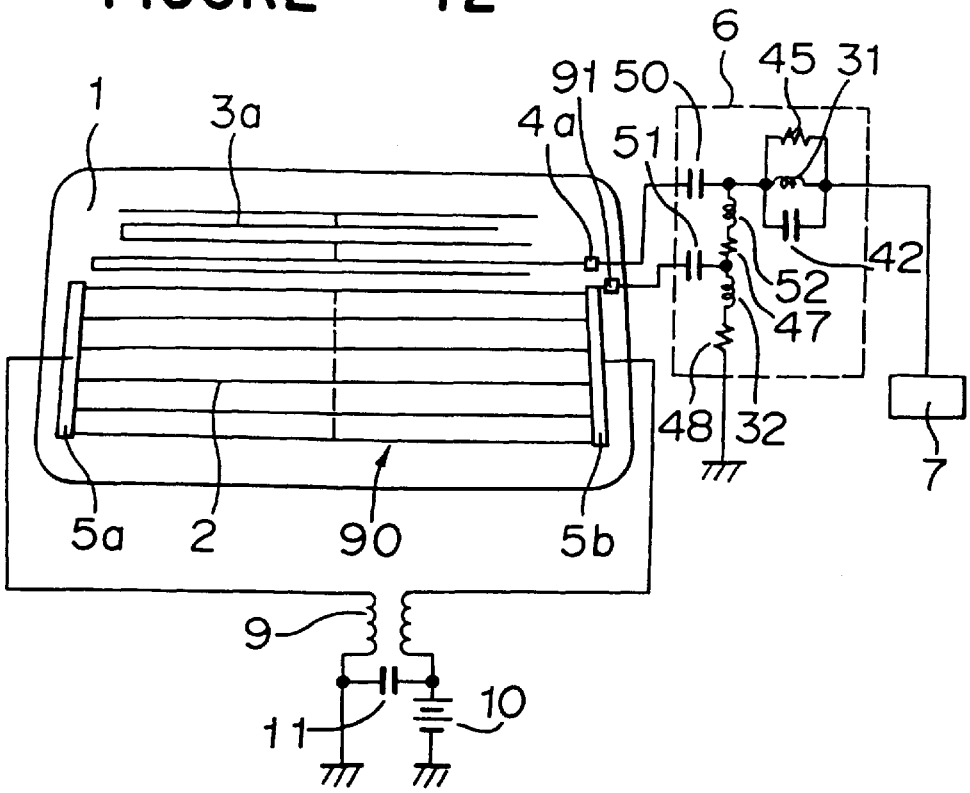
FIG. 12 is a structural diagram showing a glass antenna device for an automobile of the present invention which is of a different type from that in FIG. 1.

FIG. 12 is a structural diagram showing a glass antenna device of the present invention which is of a different type from that shown in FIG. 1. In FIG. 12, numeral 91 designates a power feeding point provided at the end of a lead wire connected to the defogger 90. In the glass antenna device for an automobile shown in FIG. 12, the second antenna conductor 3*b* shown in FIG. 1 is used as the defogger 90. FIG. 2 and description concerning FIG. 2 are applicable to the embodiment of FIG. 12, and accordingly, the second antenna conductor 3*b* should be read as the defogger 90 in the description concerning FIG. 12.

The resonance circuit shown in FIGS. 3 and 6 is also applicable to the embodiment shown in FIG. 12. However, in the glass antenna device in FIG. 12, a capacitor 51 is of a special importance unlike the glass antenna device of the type shown in FIG. 1. If the capacitor 51 is not provided, i.e., the portion of the capacitor 51 is shortcircuited, a direct current flowing in the defogger 90 flows in the coil 32. Accordingly, the current capacity of the coil 32 has to be increased whereby productivity is deteriorated. Further, since the direct current flowing in the defogger 90 also flows into the automobile body as the earth through the coil 32, the current wastes. Accordingly, it is preferable to provide the capacitor 51.

In FIG. 12, since the capacitor 51 is connected between the power feeding point 91 and the second coil 32 while the power feeding point 91 is connected to the bus bar 5*b*, the capacitor 51 is connected between the bus bar 5*b* and the second coil 32. However, the present invention is not limited to the described embodiment, and the capacitor 51 may be connected between the bus bar 5*a* and the second coil 32 or it may be connected between the heater strips 2 and the second coil 32. In other words, the second coil 32 can be connected to any portion of the defogger 90.

In the embodiment shown in FIG. 12, the resonance generated in two portions increases the signal receiving sensitivity. In the first resonance, the impedance of the first antenna conductor 3*a* and the inductance of the first coil 31 are included as resonance elements.

The impedance of the first antenna conductor 3*a* is composed mainly of a stray capacitance 33. The impedance of the first antenna conductor 3*a* is the impedance of the first antenna conductor side viewed from the power feeding point 4*a*.

The resonance frequency of the first resonance may be adjusted by connecting a capacitive component in parallel between the stray capacitance 33 and the automobile body as the earth. This capacitive component can be a resonance element for the first resonance.

Further, since the first antenna conductor 3*a* is electrically connected to the defogger 90, the impedance of the defogger 90 also influences the first resonance and can be a resonance element for the first resonance.

The impedance of the defogger 90 is composed mainly of a stray capacitance 34. The impedance of the defogger 90 is the impedance of the defogger side viewed from the power feeding point 91. Further, the stray capacitance of a wire in the vicinity of the first coil 31, the stray capacitance of a cable connected between the glass antenna and the receiver and the close capacitance 35 also influence the first resonance, and these can be resonance elements for the first resonance. The first resonance is a series resonance in the embodiment shown in FIG. 12.

Impedance matching between the first antenna conductor 3*a* and a receiver side circuit may be conducted by providing a circuit element in the resonance circuit 6. For the first coil 31, such one having about 10 $\mu$H-l mH is generally used.

In the second resonance, at least one of the inductance of the second coil 32 and the inductance of the choke coil 9 and the impedance of the defogger 90 are included as resonance elements.

Further, since the first antenna conductor 3*a* is electrically connected to the defogger 90, the impedance of the first antenna conductor 3*a* influences the second resonance and it can be a resonance element for the second resonance. Further, the stray capacitance of a wire in the vicinity of the first antenna conductor 3*a*, the stray capacitance of a wire in the vicinity of the defogger 90, the stray capacitance of a wire in the vicinity of the second coil 32 and the close capacitance 35 also influence the second resonance and they can be resonance elements for the second resonance. The stray capacitance of the cable connected between the output terminal of the resonance circuit 6 and the receiver also influences the second resonance. The second resonance in the embodiment shown in FIG. 12 is a parallel resonance.

In FIG. 12 a case that, the inductance of the second coil 32 and the inductance of the choke coil 9 and the impedance of the defogger 90 are included as resonance elements will be described. The inductance of a parallel connection circuit of the second coil 32 and the choke coil 9 and the impedance of the defogger 90 are included as resonance elements. In this case, it is preferable to satisfy $1.5 \cdot L_2 \leqq L_{CH}$ where $L_2$ represents the inductance value of the second coil 32 and $L_{CH}$ represents the inductance value of the choke coil 9, more preferably, $2 \cdot L_2 \leqq L_{CH}$. The reason is as follows. The choke coil 9 receives a large amount of electric current of several tend A(ampere) which flows in the defogger 90. Accordingly, the current capacity has to be large. In a large scale production of the choke coil, there is generally a scattering of about ±30% in $L_{CH}$, which causes a scattering in the resonance frequency for the second resonance, and accordingly, there causes a scattering in the sensitivity to signals in a low frequency band region. In the device shown in FIG. 12, the inductance of the parallel connection circuit of the second coil 32 and the choke coil 9 primarily produces the second resonance. Accordingly, satisfaction of $1.5 \cdot L_2 \leqq L_{CH}$ reduces the influence of the inductance of the choke coil 9 to the second resonance, and accordingly, the scattering of the resonance frequency for the second resonance can be reduced. In the case of $1.5 \cdot L_2 \leqq L_{CH}$, the scattering of the parallel connection circuit of the second coil 32 and the choke coil 9 can be reduced to ±15% or less even when there is scattering of ±30% in $L_{CH}$.

In FIG. 12, the resonance frequency for the first resonance and the resonance frequency for the second resonance should be such ones as to increase the sensitivity to signals in a low frequency band. When a low frequency band is for a middle wave broadcast band, the resonance frequency for a parallel resonance is preferably 350–530 kHz, more preferably, 450–500 kHz from the viewpoint of increasing the S/N ratio.

Further, the resonance frequency for the second resonance may be adjusted by connecting a capacitive component in parallel between the stray capacitance 34 and the automobile body as the earth. Such capacitive component can be a resonance element for the second resonance. For the second coil 32, such one having about 10 $\mu$H-l mH is generally used.

In FIG. 12, the high frequency choke coil 52 as an inductance element is provided according to requirement, and the high frequency choke coil 52 isolates the first antenna conductor 3*a* from the defogger 90 with respect to high frequency signals in a high frequency band. Further, it functions to improve the signal receiving sensitivity in a high frequency band without changing the effective length of the first antenna conductor 3*a*.

When the high frequency choke coil 52 is not provided; the choke coil 9 or the second coil 32 exhibits a low self-resonance frequency in a high frequency band and indicates a strong capacitive property, received signals in a high frequency band which are excited in the first antenna conductor 3*a* leak to the automobile body as the earth. In order to prevent such disadvantage, the high frequency choke coil 52 is provided. A high frequency choke coil 52 of about 0.1–1000 $\mu$H is generally used in the embodiment shown in FIG. 12. It is preferable to determine the inductance value of the high frequency choke coil 52 in such a manner that with the provision of the high frequency choke coil 52, the sensitivity in a high frequency band is improved 0.3 dB or more.

Further, when the low frequency band is for a middle wave broadcast band and the high frequency band is for at least one of an FM broadcast band, a TV-VHF band and TV-UHF band, a high frequency choke coil 52 of 0.5–10 $\mu$H is generally used. When the high frequency choke coil 52 is within the range of 0.5–10 $\mu$H, the sensitivity is improved 2 dB or more in comparison with a case out of the range of 0.5–10 $\mu$H.

In FIG. 12, the high frequency choke coil 52 is connected between the first antenna conductor 3*a* and the defogger 90 in order to prevent received signals in a high frequency band excited in the first antenna conductor 3*a* from leaking to the automobile body as the earth. However, the present invention is not limited thereto, and any filter circuit may be connected between the first antenna conductor 3*a* and the defogger 90 as far as it can block or attenuate the received signals in the high frequency band.

Further, in FIG. 12, it is preferable that the first antenna conductor 3*a* and the defogger 90 is not in a capacitive coupling relation. When the both members have a capacitive coupling relation, received signals in a high frequency band excited in the first antenna conductor 3*a* are apt to leak to the automobile body as the earth through the defogger 90 and the choke coil 9.

Figure 13:
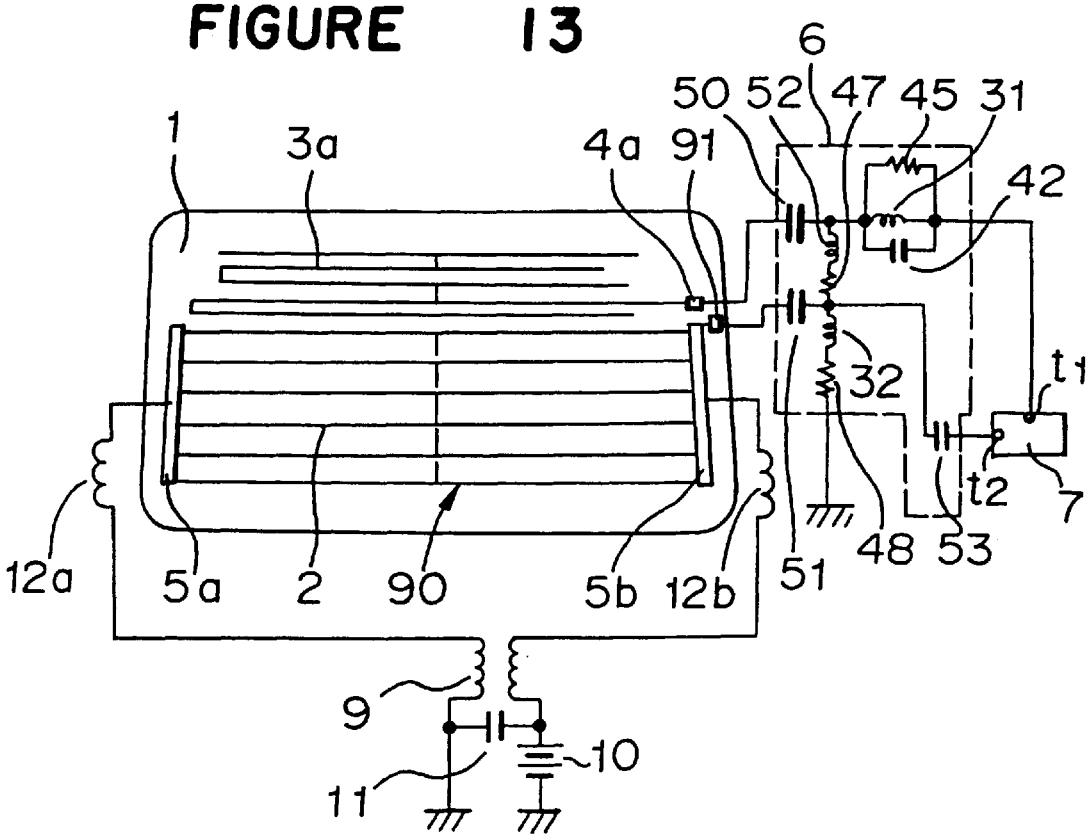
FIG. 13 is a structural diagram showing a glass antenna device for an automobile of the present invention which is of a different type from that shown in FIG. 1.

FIG. 13 shows a modified form of the glass antenna device for an automobile shown in FIG. 12 wherein it is adaptable to diversity reception. In FIG. 13, numeral 53 designates a capacitor, symbol t1 designates the first input terminal of the receiver 7 and symbol t2 designates the second input terminal of the receiver 7. The receiver 7 is adapted to select a stronger received signal of high frequency band between the first input terminal t1 and the second input terminal t2.

The capacitor 53 is provided according to requirement, which functions to block or attenuate received signals in a low frequency band. The capacitance value of the capacitor 53 is preferably in a range of 10–150 pF, more preferably, 20–70 pF. When the low frequency band is used for a middle wave broadcast band and the capacitance value of the capacitor 53 is to be 10–150 pF, the sensitivity in the middle wave broadcast band is improved 1 dB or more in comparison with a case where the capacitance value is out of the range of 10–150 pF. When the capacitance value of the capacitor 53 is to be 20–70 pF, the sensitivity in the middle wave broadcast band is improved 1 dB or more in comparison with a case where the capacitance value is out of the range of 20–70 pF.

In the glass antenna device for an automobile shown in FIG. 13, it is preferable to connect the high frequency choke coils 12*a*, 12*b* between the bus bars and the choke coil 9 in the same manner as in FIG. 9. The high frequency choke coils 12*a*, 12*b* prevent received signals of high frequency band excited in the defogger 90 from leaking to the automobile as the earth. Since the received signals of high frequency band excited in the defogger 90 are inputted to the second input terminal t2, which is not used in the device shown in FIG. 12, the received signals of high frequency band excited in the defogger 90 are prevented from leaking to the automobile body as the earth by means of the high frequency choke coils 12*a*, 12*b*. The resonance circuit 6 in FIG. 13 is applicable to the glass antenna device for an automobile according to the other embodiments.

Figure 14:
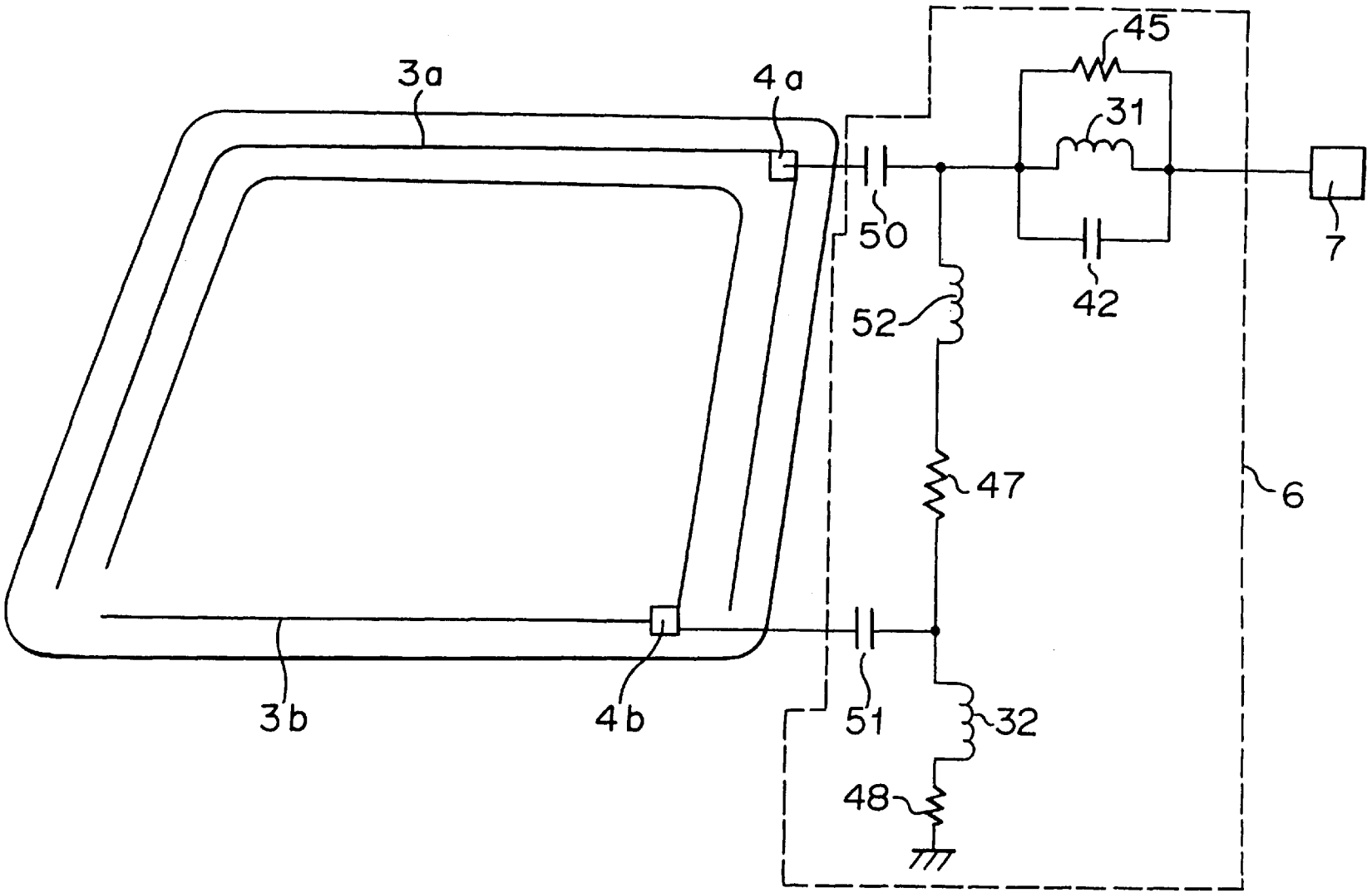
FIG. 14 is a structural diagram showing a case that the glass antenna device for an automobile of the present invention is provided in a side window glass sheet.

FIG. 14 is a diagram showing the basic structure of the glass antenna device for an automobile of the present invention which is provided in a side window glass sheet. The resonance circuit 6 shown in FIGS. 3 and 6 is also applicable to the resonance circuit 6 shown in FIG. 14.

Figure 7:
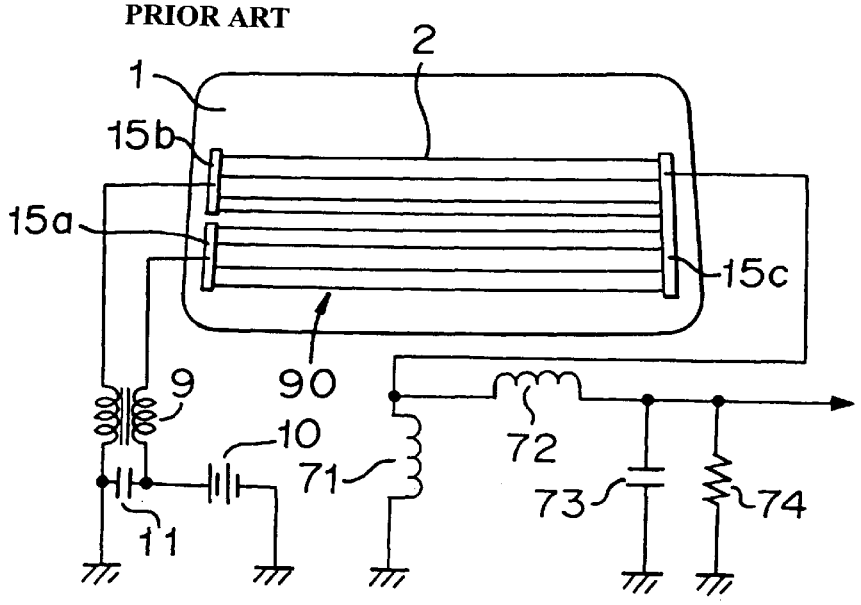
FIGURE 7 PRIOR ART
FIG. 7 is a structural diagram showing an antenna device according to the conventional technique.

The defogger 90 shown in FIGS. 1, 8, 9, 12, and 13 is in a trapezoidal form, however, the defogger 90 according to the present invention is not limited thereto, and a channel-like defogger 90 as shown in FIG. 7 can be utilized.

The first antenna conductor 3*a* and the second antenna conductor 3*b* may be provided in any space of upper, lower, left or right portion with respect to the defogger 90 in the window glass sheet 1, and the position is not limited to that shown in FIG. 1. Further, the number of antenna conductors to be provided in the window glass sheet 1 is not limited as far as the number is two or more.

In the present invention, there is no limitation of the number of antenna conductors to be provided on the automobile other than the first antenna conductor 3*a* and the second antenna conductor 3*b*. Further, the glass antenna device of the present invention is so adapted as to perform diversity reception in association with another antenna device such as a pole antenna or the like or another glass antenna device.

The power feeding points 4*a*, 4*b* are arranged in a right peripheral portion in the window glass sheet 1 in FIG. 1. However, the present invention is not limited thereto, and it may be arranged at any position of the window glass sheet 1. For example, it may be arranged upper and lower circumferential portions of the center of the left and right sides of the window glass sheet 1.

Either of the first antenna conductor 3*a* or the second antenna conductor 3*b* shown in FIG. 1 is not provided with an auxiliary antenna conductor. For phase adjustment and/or directivity adjustment, however, an auxiliary antenna conductor having a substantially T-like shape or a substantially L-like shape may be connected to a suitable portion of a conductor pattern of the antenna conductor or the feeding point.

In the present invention, the window glass sheet in which the first antenna conductor 3*a* and the second antenna conductor 3*b* are provided is not limited to the rear window glass sheet, and it may be a side window glass sheet, a front window glass sheet, a top window glass sheet or the like. Further, it is not always necessary to provide the defogger 90 in the window glass sheet where the antenna conductors are provided.

The defogger 90 shown in FIGS. 12 and 13 is in a trapezoidal form. However, the defogger according to the present invention is not limited thereto, and a substantially channel-like defogger as shown in FIG. 7 can be utilized.

EXAMPLE

EXAMPLE 1

A rear window glass sheet for an automobile was used and a glass antenna device as shown in FIG. 1 was formed therein. For the resonance circuit 6, a circuit as shown in FIG. 3 was employed wherein the resistors 47, 48 and 49 and capacitors 50 and 51 were not provided (the resistors 47 and 48 and the capacitors 50 and 51 were shortcircuited, and the resistor 49 was opened). The circuit constants of the elements used were as follows.

First coil 31: 220 μH

Second coil 32: 680 μH

Capacitors 41, 44: 2200 pF

Bypass capacitor 42: 22 pF

Capacitor 43: 39 pF

Resistor 45: 10 kΩ

Resistor 46: 15 kΩ

The length and the shape of the first antenna conductor 3*a* were adjusted so as to obtain a preferable signal receiving performance in an FM broadcast band. The length of the second antenna conductor 3*b* was elongated as possible by maximizing the unable area so that signals in a middle wave broadcast band could be received preferably.

The distance between the upper portion or the lower portion of the first antenna conductor 3*a* and the second antenna conductor 3*b* was determined to be 10 mm. The distance between the second antenna conductor 3*b* and the uppermost line of the heater strips 2 was elongated to be 20 mm. In this case, the second antenna conductor 3*b* and the defogger 90 are in a slight capacitive coupling relation.

Determination was so made that the width of the uppermost element of the first antenna conductor 3*a* was 730 mm: the width of the intermediate element was 680 mm: the width of the lowermost element (excluding the power feeding point 4*a*) was 780 mm: the distance between the uppermost element and the intermediate element was 15 mm; and the distance between the intermediate element and the lowermost element was 15 mm.

Further, determination was so made that the width of each of four elements of the second antenna conductor 3*b* (excluding the power feeding point 4*b* with respect to the second element from the lowest position) was 800 mm and the distance between the uppermost element and the lowermost element was 73.5 mm. The line width of the first antenna conductor 3*a* and the second antenna conductor 3*b* was 0.7 mm respectively.

Figure 4:
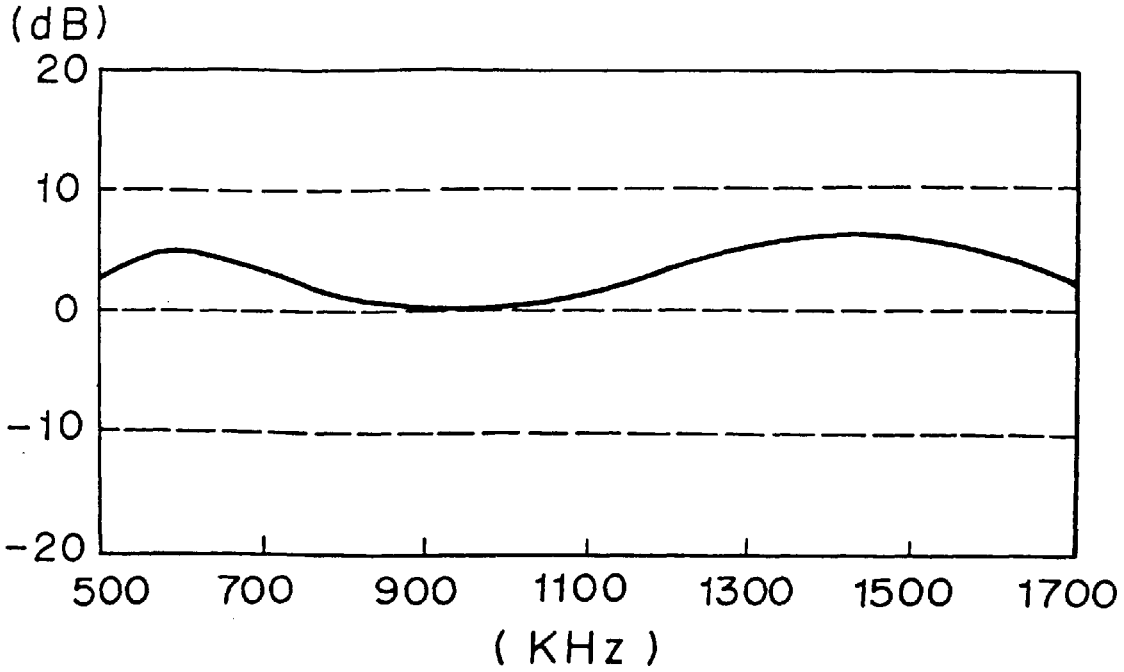
FIG. 4 is a sensitivity vs frequency characteristic diagram in the first embodiment.

FIG. 4 is a characteristic diagram showing the sensitivity in a middle wave broadcast band. FIG. 4 is based on a comparison in the sensitivity with a pole antenna having a length of 870 mm wherein the sensitivity of the pole antenna is 0 dB. With respect to the sensitivity in an FM broadcast band, the substantially same result (within ±2 dB) as in the pole antenna having a length of 870 mm was obtainable. The resonance frequency of the first resonance was 1450 kHz and the resonance frequency of the second resonance was 600 kHz.

EXAMPLE 2 (comparative example)

The conventional glass antenna device for an automobile as shown in FIG. 7 was formed. Determination was so made that the coil 71 was of 680 μH, the coil 72 was of 100 μH, the capacitor 73 was of 30 pF and the resistor 74 was of 5 kΩ. The same window glass sheet and the same defogger 90 to be provided in the window glass sheet as in Example 1 were used.

Figure 5:
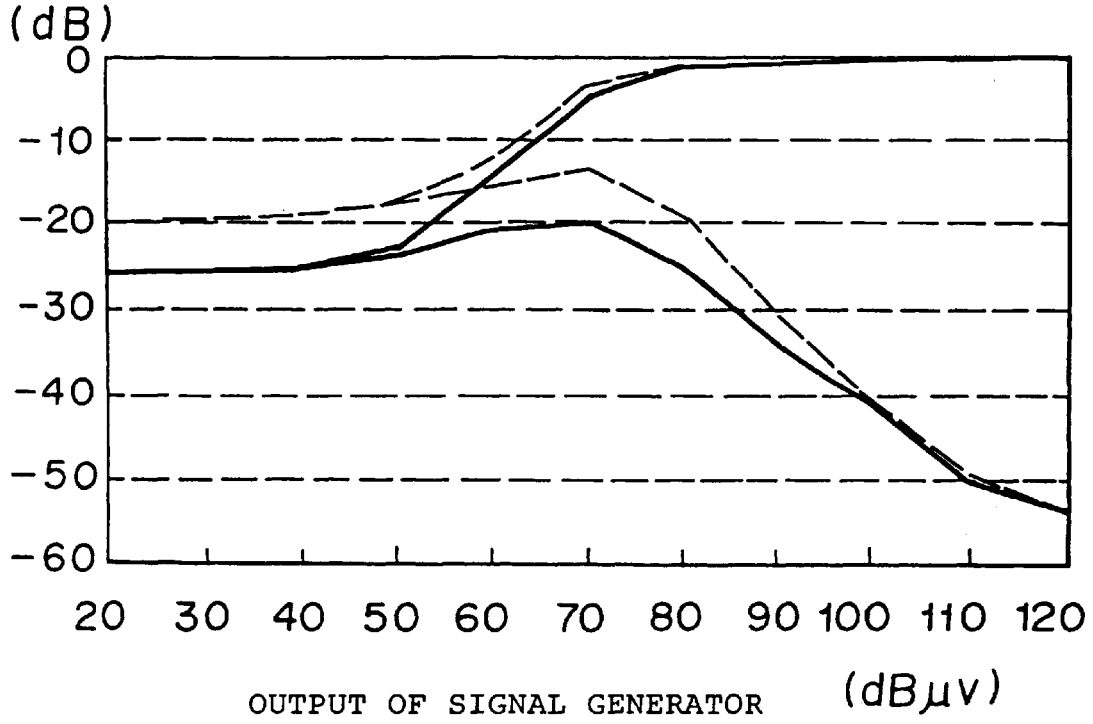
FIG. 5 is a S/N characteristic diagram in the first embodiment and the conventional example.

FIG. 5 is a S/N characteristic diagram at 600 kHz. Measurement was conducted by emitting an electric radiation through a signal transmitting antenna connected to a signal generator in a sealed room. In FIG. 5, the abscissa represents an output voltage from the signal generator and the ordinate represents an output voltage (unit: dB) from a low frequency amplifier circuit provided at the final stage of the receiver. When the output of the signal generator was 120 dBμV, a sufficient input was applied to the receiver so that the S/N became a saturated state. With respect to the modulation of the signal generator, a modulated frequency of 400 Hz was employed to obtain a modulated degree of 30%. This condition was standardized as 0 (zero) dB in the ordinate.

In FIG. 5, a solid line shows the S/N characteristic of example 1 and a dotted line shows the S/N characteristic of example 2. Both the solid line and the dotted line are respectively branched vertically at 50–120 dBμV. Each upper branch line shows a state that the modulation was conducted (voice signal (S)+noise (N)) and each lower branch line shows a state that no modulation is conducted to the electric radiation from the signal transmitting antenna (no-modulation state, only noise (N)).

As the difference of dB between the upper line and the lower line becomes large, the S/N ratio becomes large whereby a preferable signal reception is obtainable. The S/N characteristics in FIG. 5 are not influenced by noises of automobile such as engine noises and so on, and there is no influence by the operation and the stop of the engine.

EXAMPLE 3

Figure 11:
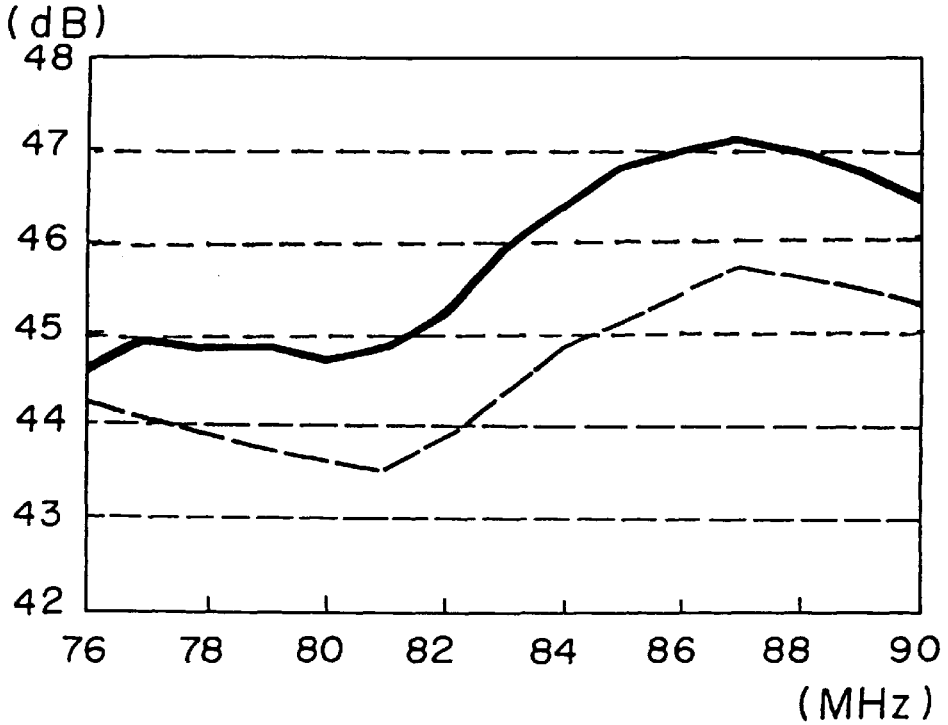
FIG. 11 is a sensitivity vs FM broadcast band frequency characteristic diagram with respect to embodiments 3 and 4.

The glass antenna device as shown in FIG. 1 was formed in a rear window glass sheet of automobile. The same resonance circuit 6 as in FIG. 6 was employed wherein the capacitors 50 and 51 and resistors 46, 48 and 49 were not provided (the resistors 46 and 49 were opened; the resistor 48 was shortcircuited and the capacitors 50 and 51 were shortcircuited). With respect to the elements used, the same circuit constants as in Example 1 were used except for the first coil 31, the coil 52 and the resistor 47. The circuit constants of these elements were as follows. In FIG. 11, a solid line shows a result of the measurement of the FM broadcast band sensitivity in Example 3.

First coil 31: 120 μH

High frequency choke coil 52: 2.7 μH

Resistor 47: 220Ω

EXAMPLE 4

The glass antenna device as shown in FIG. 1 was formed in the same manner as in Example 3 except that the high frequency choke coil was not provided. In FIG. 11, a dotted line shows a result of the measurement of the FM broadcast band sensitivity of Example 4.

EXAMPLE 5

The glass antenna device as shown in FIG. 9 was formed in a rear window glass sheet of automobile wherein the first antenna conductor 3*a*, the second antenna conductor 3*b* and the defogger 90 were the same as those in Example 1. The same resonance circuit 6 as in FIG. 6 was employed wherein the capacitors 41 and 44 and the resistors 46 and 48 were not provided (the resistor 46 was opened, the capacitors 41 and 44 and the resistors 48 were shortcircuited).

A high frequency choke coil of 2.2 μH was connected in series to the second coil 32. No high frequency choke coils 12*a*, 12*b* were not provided. The shortest distance between the second antenna conductor 3*b* and the defogger 90 was 10 mm, and the coupling capacitance between the second antenna conductor 3*b* and the defogger 90 was 80 pF. The circuit constants of the elements used were as follows.

First coil 31: 150 μH

Second coil 32; 680 μH

Capacitors 50, 51: 1000 pF

Coil 52: 2.2 μH

Resistor 47: 270Ω

Resistor 49: 10kΩ

Resistor 45: 15 kΩ

Bypass capacitor 42: 22 pF

Choke coil 9: 1 mH

The sensitivity in a middle wave broadcast band was improved about 4 dB or more in average in comparison with that in Example 1. Further, the sensitivity in an FM broadcast band was substantially the same as that in Example 1.

EXAMPLE 6

The glass antenna device as shown in FIG. 12 was formed in a rear window glass sheet of automobile. The circuit constants of the elements used were as follows.

First coil 31: 150 μH

Second coil 32: 560 μH

High frequency choke coil 52: 2.2 μH

Bypass capacitor 42: 22 pF

Resistor 45: 15 kΩ

Resistor 47: 270Ω

Resistor 48: 220Ω

Capacitors 50, 51: 1000 pF

Choke coil 9: 1.6 mH

Stray capacitance of defogger 90: 100 pF

The length and the shape of the first antenna conductor 3*a* were adjusted so as to receive signals in a middle wave broadcast band and an FM broadcast band. The distance between a lower portion of the first antenna conductor 3*a* and the uppermost line of the heater strips was elongated to 15 mm. In this case, the first antenna conductor 3*a* and the defogger 90 had a slight capacitive coupling.

Figure 15:
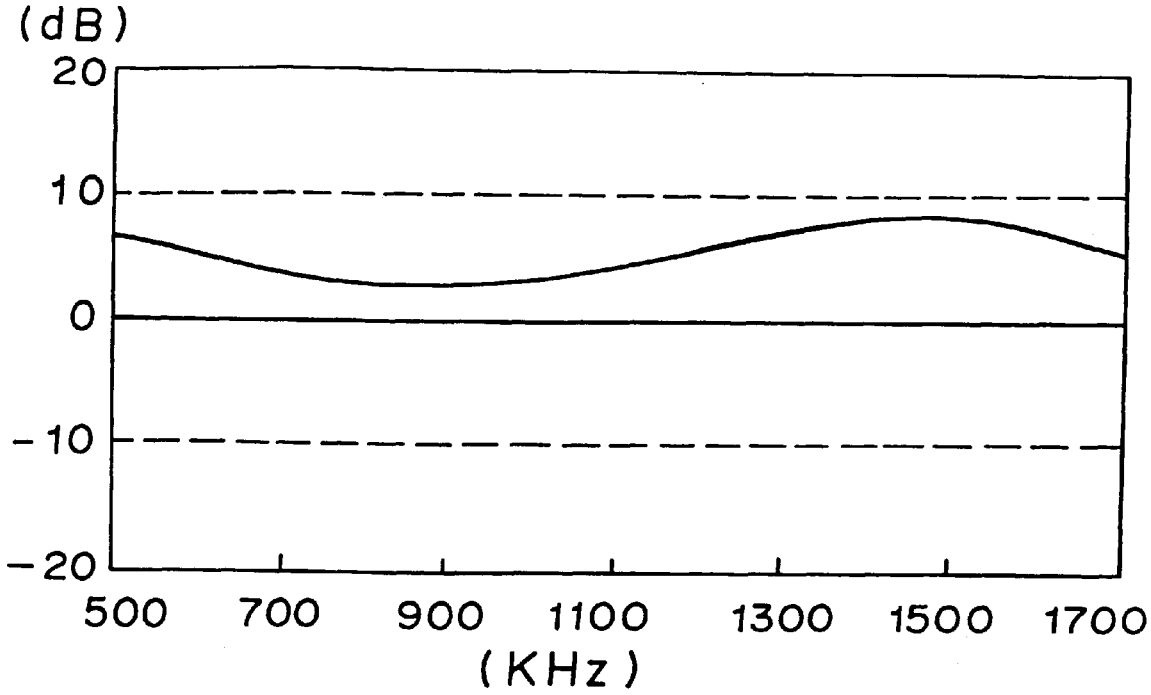
FIG. 15 is a sensitivity vs middle broadcast band frequency characteristic diagram in embodiment 6.
Figure 16:
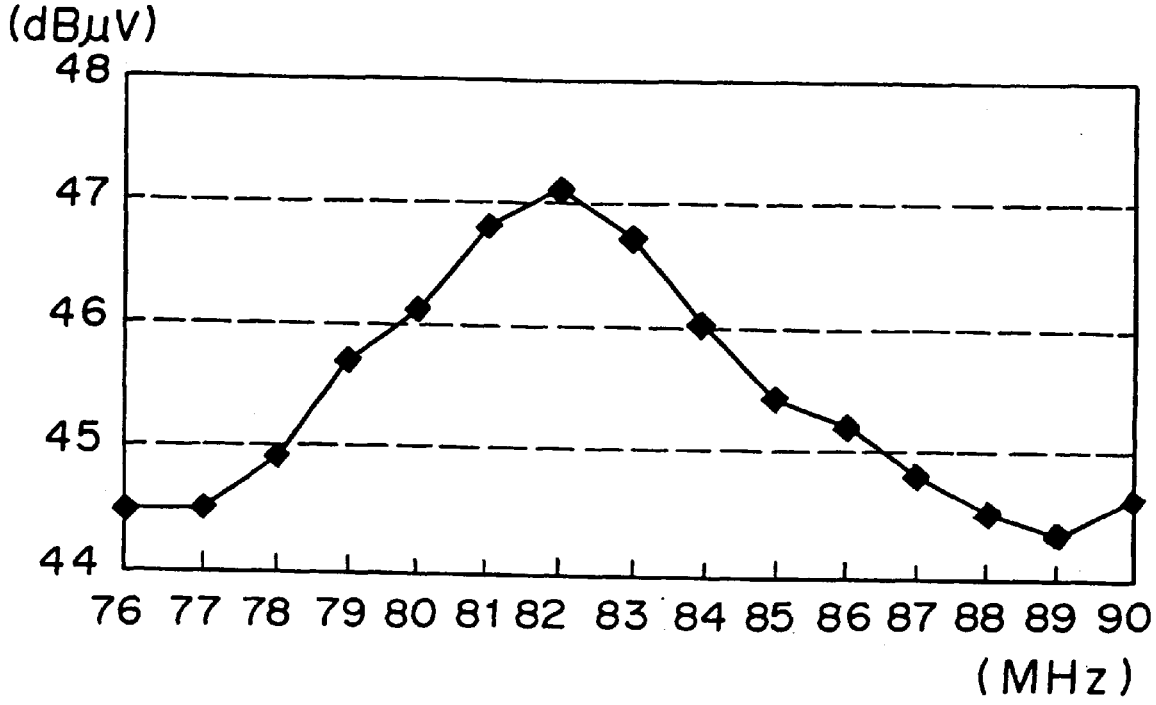
FIG. 16 is a sensitivity vs FM broadcast band frequency characteristic diagram in embodiment 6.

FIG. 15 is a characteristic diagram showing the sensitivity in the middle wave broadcast band. FIG. 15 was based on the comparison in the sensitivity with a pole antenna having a length of 910 mm wherein the sensitivity of the pole antenna was taken as 0 dB. The resonance frequency of the first resonance (series resonance) was 1450 kHz and the resonance frequency of the second frequency (parallel frequency) was 480 kHz. FIG. 16 is a characteristic diagram showing the sensitivity in the FM broadcast band.

According to the present invention, the first resonance is generated by the impedance of the first antenna conductor and the inductance of the first coil as resonance elements, and the second resonance is generated by the impedance of the second antenna conductor and the inductance of the second coil as resonance elements. Thus, the sensitivity is improved by utilizing the resonance in two portions. Further, since the stray capacitance of the cable connected between the glass antenna and the receiver influences little the second resonance, the S/N ratio is improved remarkably.

In the present invention, even when signals in two different frequency bands: a low frequency band and a high frequency band, are to be received, the first antenna conductor is so designed as to be suitable for received signals of high frequency band, and the second antenna conductor is so designed as to be suitable for received signals of low frequency band. Accordingly, the signals in the both frequency bands are well received.

Further, since adjustment for received signals in the both frequency bands can be independently conducted, the adjustment is easy and productivity is improved.

Further, since the first resonance and the second resonance can be generated without utilizing the defogger as an antenna, the choke coil 9 which were required in the conventional glass antenna device is unnecessary, and productivity is improved.

When the second antenna is used as the defogger and a combination of the first antenna conductor and the defogger is used as an antenna, both the first antenna conductor and the defogger can be utilized for received signals of low frequency band, whereby the sensitivity to the low frequency band is excellent. when signals of high frequency band are to be received, the effective length of only the first antenna conductor can be utilized whereby the sensitivity to the high frequency band is excellent. When the received signals of high frequency band in the defogger are not utilized, the high frequency choke coils 12*a*, 12*b* can be omitted to thereby improve productivity.

What is claimed is:

1. In a glass antenna device for an automobile wherein an electric heating type defogger having heater strips and bus bars for feeding a current to the heater strips, and an antenna conductor are provided on a rear window glass sheet fitted to a rear window opening of an automobile; a choke coil is connected to at least one of 1) between a bus bar and a d.c. power source and 2) between another bus bar and the automobile body as the earth; and the antenna conductor and a receiver are connected with a cable, the glass antenna device including:

a first coil; and a second coil, wherein:

a first resonance is generated by the impedance of the antenna conductor and the inductance of the first coil as resonance elements;

a second resonance is generated by the impedance of the cable and the inductance of the second coil as resonance elements;

a received signal in a first received signal frequency band and a received signal in a second received signal frequency band which is higher in frequency than the first received signal frequency band are supplied from the antenna conductor to the receiver, a resonance frequency which causes the first resonance and a resonance frequency which causes the second resonance are frequencies by which the sensitivity to the first received signal frequency band is increased;

a filter circuit configured to block or attenuate the received signal in the second received signal frequency band is electrically connected between the antenna conductor and the defogger; and the first coil is electrically connected between the antenna conductor and the receiver.

2. A glass antenna device for an automobile according to claim 1, wherein the filter circuit is provided with a serial connection circuit of a high frequency choke coil and a resistor.

3. A glass antenna device for an automobile according to claim 2, wherein the first resonance is a series resonance and the second resonance is a parallel resonance.

4. A glass antenna device for an automobile according to claim 2, wherein the first received signal frequency band is a middle frequency band and the second received signal frequency band is at least one selected from the group consisting of an FM broadcast band, a TV-VHF band and a TV-UHF band.

5. A glass antenna device for an automobile according to claim 1, wherein the second coil is electrically connected between the receiver and the automobile body as the earth.

6. A glass antenna device for an automobile according to claim 1, wherein the first resonance is a series resonance and the second resonance is a parallel resonance.

7. A glass antenna device for an automobile according to claim 1, wherein the first received signal frequency band is a middle frequency band and the second received signal frequency band is at least one selected from the group consisting of an FM broadcast band, a TV-VHF band and a TV-UHF band.

8. A glass antenna device for an automobile comprising:

a first coil;

a second coil;

a first antenna conductor provided in a window glass sheet fitted to an opening of an automobile; and a second antenna conductor provided in the window glass sheet, wherein:

a first resonance is generated by the impedance of the first antenna conductor and the inductance of the first coil as resonance elements;

a second resonance is generated by the impedance of the second antenna conductor and the inductance of the second coil as resonance elements;

a received signal in a first received signal frequency band and a received signal in a second received signal frequency band which is higher in frequency than the first received signal frequency band are supplied from the first antenna conductor to a receiver;

a resonance frequency which causes the first resonance and a resonance frequency which causes the second resonance are frequencies by which the sensitivity to the first received signal frequency band is increased;

a filter circuit configured to block or attenuate the received signal in the second received signal frequency band is electrically connected between the first antenna conductor and the second antenna conductor;

the filter circuit includes a resistor which is electrically connected between the first antenna conductor and the second antenna conductor; and the resistance of the resistor is 10 Ω–1k Ω.

9. A glass antenna device for an automobile according to claim 8, wherein the second coil is electrically connected between the second antenna conductor and the body as the earth without interposing the first coil.

10. A glass antenna device for an automobile according to claim 8, wherein the first coil is electrically connected between the first antenna conductor and the receiver, and the second coil is electrically connected between the second antenna conductor and the automobile body as the earth.

11. A glass antenna device for an automobile according to claim 8, wherein the first resonance is a series resonance and the second resonance is a parallel resonance.

12. A glass antenna device for an automobile according to claim 8, wherein the first received signal frequency band is a middle frequency band and the second received signal frequency band is at least one selected from the group consisting of an FM broadcast band, TV-VHF band and a TV-UHF band.

13. In a glass antenna device for an automobile wherein an electric heating type defogger having heater strips and bus bars for feeding a current to the heater strips, and an antenna conductor are provided on a rear window glass sheet fitted to a rear window opening of an automobiles and a choke coil is connected to at least one of 1) between a bus bar and a d.c. power source and 2) between another bus bar and the automobile body as the earth, the glass antenna device including:

a first coil; and a second coil, wherein:

a first resonance is generated by the impedance of the antenna conductor and the inductance of the first coil as resonance elements;

a second resonance is generated by the impedance of the defogger and the inductance of the second coil as resonance elements;

a received signal in a first received signal frequency band and a received signal in a second signal frequency band which is higher in frequency than the first received signal frequency band are supplied from the antenna conductor to a receiver;

a resonance frequency which causes the first resonance and a resonance frequency which causes the second resonance are frequencies by which the sensitivity to the first received signal frequency band is increased;

a filter circuit configured to block or attenuate the received signal in the second received signal frequency band is electrically connected between the antenna conductor and the defogger;

the first coil is electrically connected between the antenna conductor and the receiver; and the second coil is electrically connected between the defogger and the automobile body as the earth without interposing the first coil.

14. A glass antenna device for an automobile according to claim 13, wherein the filter circuit is provided with a serial connection circuit of a high frequency choke coil and a resistor.

15. A glass antenna device for an automobile according to claim 13, wherein a capacitor is electrically connected between an end at a defogger side of the second coil and the defogger.

16. A glass antenna device for an automobile according to claim 13, wherein the first resonance is a series resonance and the second resonance is a parallel resonance.

17. A glass antenna device for an automobile according to claim 13, wherein the first received signal frequency band is a middle frequency band and the second received signal frequency band is at least one selected from the group consisting of an FM broadcast band, a TV-VHF band and a TV-UHF band.

18. In a glass antenna device for an automobile wherein an electric heating type defogger having heater strips and bus bars for feeding a current to the heater strips, and an antenna conductor are provided on a rear window glass sheet fitted to a rear window opening of an automobile, a choke coil is connected to at least one of 1) between a bus bar and a d.c. power source and 2) between another bus bar and the automobile body as the earth; and a received signal received by the antenna conductor is supplied to a receiver, the glass antenna device including:

a first coil is electrically connected between the antenna conductor and the receiver;

a second coil is electrically connected between the defogger and the automobile body as the earth without interposing the first coil; and a filter circuit is electrically connected between the antenna conductor and the defogger.

19. A glass antenna device for an automobile according to claim 18, wherein a capacitor is electrically connected between an end at a defogger side of the second coil and the defogger.

20. A glass antenna device for an automobile according to claim 18, wherein the inductance value of the first coil is 10 $\mu$H–1 mH and the inductance value of the second coil is 10 $\mu$H–1 mH.

21. A glass antenna device for an automobile according to claim 18, wherein the filter circuit includes a high frequency choke coil and the inductance value of the high frequency choke coil is 0.1–1000 $\mu$H.

22. In a glass antenna device for an automobile, wherein an electric heating type defogger having heater strips and bus bars for feeding a current to the heater strips, and an antenna conductor are provided on a rear window glass sheet fitted to a rear window opening of an automobile; a choke coil is connected to at least one of 1) between a bus bar and a d.c. power source and 2) between another bus bar and the automobile body as the earth; and a received signal in a first received signal frequency band and a second received signal frequency band which is higher in frequency than the first received signal frequency band are received, the glass antenna including:

a first coil as a resonance element for a first resonance; and a second coil, wherein:

the inductance of a parallel connection circuit of the second coil and the choke coil, and the impedance of the defogger are included mainly in a resonance element for a second resonance;

a filter circuit configured to block or attenuate the received signal in the second received signal frequency band is electrically connected between the antenna conductor and the defogger; and a resonance frequency which causes the first resonance and a resonance frequency which causes the second resonance are frequencies by which the sensitivity to the first received signal frequency band is increased.

23. A glass antenna device for an automobile according to claim 22, wherein the second resonance is a parallel resonance.

24. A glass antenna device for an automobile according to claim 22, wherein $1.5 \cdot L_2 \leqq L_{CH}$, where $L_2$ is the inductance of the second coil, and $L_{CH}$ is the inductance of the choke coil.

* * * * *